US011238827B2

(12) United States Patent
Huang

(10) Patent No.: US 11,238,827 B2
(45) Date of Patent: Feb. 1, 2022

(54) VOLTAGE REGULATION CIRCUIT SUPPLYING REFERENCE VOLTAGE TO DISPLAY DEVICE

(71) Applicants: HKC Corporation Limited, Shenzhen (CN); Chongqing HKC Optoelectronics Technology Co., Ltd., Chongqing (CN)

(72) Inventor: Xiaoyu Huang, Chongqing (CN)

(73) Assignees: HKC Corporation Limited, Shenzhen (CN); Chongqing HKC Optoelectronics Technology Co., Ltd, Chongqing (CN)

( * ) Notice: Subject to any disclaimer, the term of this patent is extended or adjusted under 35 U.S.C. 154(b) by 0 days.

(21) Appl. No.: 17/042,808

(22) PCT Filed: Nov. 6, 2018

(86) PCT No.: PCT/CN2018/114109
§ 371 (c)(1),
(2) Date: Sep. 28, 2020

(87) PCT Pub. No.: WO2020/037833
PCT Pub. Date: Feb. 27, 2020

(65) Prior Publication Data

US 2021/0020138 A1 Jan. 21, 2021

(30) Foreign Application Priority Data

Aug. 24, 2018 (CN) ..... 201810974612.9

(51) Int. Cl.
*G09G 3/36* (2006.01)

(52) U.S. Cl.
CPC ..... *G09G 3/3696* (2013.01); *G09G 2310/08* (2013.01)

(58) Field of Classification Search
CPC ..... G09G 3/30; G09G 3/32; G09G 3/3208; G09G 3/3216; G09G 3/3225;
(Continued)

(56) References Cited

U.S. PATENT DOCUMENTS

2002/0008686 A1* 1/2002 Kumada ..... G09G 3/3696 345/94
2002/0105494 A1* 8/2002 Lin ..... G09G 3/3696 345/101
(Continued)

FOREIGN PATENT DOCUMENTS

CN 103260314 A 8/2013
CN 105931610 A 9/2016
(Continued)

OTHER PUBLICATIONS

International Search Report dated May 16, 2019 issued in corresponding International Application No. PCT/CN2018/114109, filed Nov. 6, 2018, 2 pages.
(Continued)

*Primary Examiner* — Alexander Eisen
*Assistant Examiner* — Nelson Lam
(74) *Attorney, Agent, or Firm* — Christensen O'Connor Johnson Kindness PLLC

(57) ABSTRACT

A voltage regulator circuit includes a power chip, a controlling chip, and a regulating chip. The controlling chip is configured to transmit a control signal, the regulating chip is configured to regulate an outputted voltage from the power chip to a preset voltage according to the control signal. The controlling chip is further configured to convert the preset voltage to a reference voltage.

17 Claims, 2 Drawing Sheets

(58) Field of Classification Search
CPC ..... G09G 3/3233; G09G 3/36; G09G 3/3611; G09G 3/3622; G09G 3/3625; G09G 3/3685; G09G 3/3688; G09G 3/3696
USPC ..... 345/76–83, 87–104
See application file for complete search history.

(56) References Cited

U.S. PATENT DOCUMENTS

2005/0156854 A1* 7/2005 Park ..... G09G 3/3696 345/100
2008/0278428 A1* 11/2008 Song ..... G09G 3/3696 345/98
2010/0181972 A1* 7/2010 Kawagoshi ..... G05F 1/571 323/269
2011/0043505 A1* 2/2011 Ahn ..... G09G 3/3233 345/211
2011/0181578 A1* 7/2011 Ohta ..... G09G 3/20 345/211
2013/0106676 A1* 5/2013 Ono ..... G09G 3/30 345/76
2015/0138056 A1* 5/2015 Woo ..... G09G 3/3696 345/89
2015/0280700 A1* 10/2015 Lai ..... H03K 17/08122 345/215
2017/0003779 A1* 1/2017 Reynolds ..... G06F 3/04166
2017/0004769 A1* 1/2017 Nathan ..... G09G 3/3283
2017/0060166 A1* 3/2017 Shukla ..... G05F 3/267
2018/0097439 A1* 4/2018 Maki ..... H02M 1/32
2018/0211588 A1* 7/2018 Lin ..... G09G 3/3208

FOREIGN PATENT DOCUMENTS

CN 105957486 A 9/2016
CN 105976764 A 9/2016
CN 106157913 A 11/2016
CN 106157915 A 11/2016
CN 106710531 A 5/2017
CN 207352504 A 5/2018
KR 20140143593 A 12/2014

OTHER PUBLICATIONS

Office Action dated May 13, 2019, issued in Chinese Application No. 201810974612.9, filed Aug. 8, 2018, 7 pages.

* cited by examiner

VOLTAGE REGULATION CIRCUIT SUPPLYING REFERENCE VOLTAGE TO DISPLAY DEVICE

TECHNICAL FIELD

The present disclosure relates to a field of display technology, and particularly to a voltage regulator circuit and a display device.

BACKGROUND

The thin film transistor liquid crystal display (TFT-LCD) is one of the main types of flat panel display. The basic driving principle of TFT-LCD is as follows: R/G/B compressed signal and power control are signal transmitted through a wire from the system board to the printed circuit board (PCB), and are processed by the timing controller (TCON) and integrated circuit (IC) on the PCB, then are transmitted to a display area by the source chip-on-film (S-COF) and the gate chip-on-film (G-COF), thereby the display receiving the required power and signal.

In order to ensure that the voltage outputted from the S-COF conforms to the viewing habit of the human eye, it is necessary to input a reference voltage to the S-COF as a reference value of the output voltage. In the conventional configuration, an external power chip supplies a constant supply voltage to a reference voltage chip, so as to generate the required reference voltage. Due to the design of the reference voltage chip, the outputted reference voltage can only be less than the supply voltage. Since the supply voltage from a conventional external power chip can be unstable, when the supply voltage is too high, the temperature of the S-COF is too high. When the supply voltage is too low, the reference voltage required cannot be generated. And when the supply voltage is determined, if the supply voltage value needs to be changed, the hardware circuit needs to be changed, which is costly and inefficient.

SUMMARY

According to various embodiments of the present disclosure, a voltage regulator circuit and a display device are provided.

A voltage regulator circuit includes:

a power chip;

a controlling chip, configured to transmit a control signal; and a regulating chip, connected to the power chip and the controlling chip, and configured to regulate an outputted voltage from the power chip to a preset voltage according to the control signal, and transmit the preset voltage to the controlling chip.

The controlling chip is further configured to convert the preset voltage to a reference voltage.

In one of the embodiments, the regulating chip includes:

a first gate circuit connected to the controlling chip, and configured to receive the controlling signal;

a second gate circuit connected to the controlling chip, and configured to receive the controlling signal; and a bias circuit, the first gate circuit is connected in parallel with the second gate circuit and the connected first gate circuit and second gate circuit are in series with the bias circuit, and the first gate circuit, second gate circuit, and the bias circuit are located between a voltage output terminal of the power chip and ground.

The control signal includes: a first control signal turning on the first gate circuit while turning off the second gate circuit, and a second control signal turning off the first gate circuit while turning on the second gate circuit.

In one of the embodiments, the first control signal is at a high level, and the second control signal is at a low level.

In one of the embodiments, the preset voltage includes a first preset voltage and a second preset voltage;

in response to detecting that the controlling chip transmits the first control signal to the first gate circuit and the second gate circuit, the first gate circuit is tuned on, the outputted voltage from the power chip is regulated to the first preset voltage and is transmitted to the controlling chip;

in response to detecting that the controlling chip transmits the second control signal to the first gate circuit and the second gate circuit, the second gate circuit is tuned on, the outputted voltage from the power chip is regulated to the second preset voltage and is transmitted to the controlling chip.

In one of the embodiments, the first preset voltage is 15V, and the second preset voltage is 18V.

In one of the embodiments, the voltage regulator circuit further includes a feedback circuit. The feedback circuit is connected to the bias circuit and the power circuit, respectively, and the feedback circuit is configured to detect a bias voltage of the bias circuit and feedback the detected bias voltage to the power chip.

In response to detecting that the bias voltage is equal to a preset bias voltage, the outputted voltage from the power chip remains constant, in response to detecting that the bias voltage is less than the preset bias voltage, the outputted voltage is increased, and in response to detecting that the bias voltage is greater than the preset bias voltage, the outputted voltage is reduced.

In one of the embodiments, the preset bias voltage is 1.5V.

In one of the embodiments, the first gate circuit includes:

a first resistor, and a first electronic switch, a first terminal of the first electronic switch is connected to the voltage output terminal of the power chip via the first resistor, a second terminal of the first electronic switch is connected to the controlling chip, and a third terminal of the first electronic switch is connected to the bias circuit.

In one of the embodiments, the first electronic switch is a NMOS transistor, the first terminal, the second terminal and the third terminal of the first electronic switch correspond to a drain, a gate, and a source of the NMOS transistor, respectively.

In one of the embodiments, the first electronic switch is a NPN transistor, the first terminal, the second terminal and the third terminal of the first electronic switch correspond to a collector, a base, and an emitter of the NPN transistor, respectively.

In one of the embodiments, the second gate circuit includes:

a second resistor, and a second electronic switch, a first terminal of the second electronic switch is connected to the voltage output terminal of the power chip via the second resistor, a second terminal of the second electronic switch is connected to the controlling chip, and a third terminal of the second electronic switch is connected to the bias circuit.

In one of the embodiments, the second electronic switch is a PMOS transistor, the first terminal, the second terminal and the third terminal of the second electronic switch correspond to a drain, a gate, and a source of the PMOS transistor, respectively.

In one of the embodiments, the second electronic switch is a PNP transistor, the first terminal, the second terminal and the third terminal of the second electronic switch correspond to a collector, a base, and an emitter of the PNP transistor, respectively.

In one of the embodiments, the bias circuit includes a third resistor, a first terminal of the third resistor is connected to the third terminal of the first electronic switch, the third terminal of the second electronic switch, and the feedback circuit, respectively, and a second terminal of the third resistor is grounded.

In one of the embodiments, the reference voltage includes a first reference voltage converted from the first preset voltage via the controlling chip, and a second reference voltage converted from the second preset voltage via the controlling chip.

In one of the embodiments, the first reference voltage is less than the first preset voltage, and the second reference voltage is less than the second preset voltage.

A voltage regulator circuit includes:

a power chip;

a controlling chip, configured to transmit a control signal; and a regulating chip, including:

a first gate circuit connected to the controlling chip, and configured to receive the controlling signal;

a second gate circuit connected to the controlling chip, and configured to receive the controlling signal; and a bias circuit, wherein the first gate circuit is connected in parallel with the second gate circuit and the connected first gate circuit and second gate circuit are in series with the bias circuit, and the first gate circuit, second gate circuit, and the bias circuit are located between a voltage output terminal of the power chip and ground.

The control signal includes: a first control signal turning on the first gate circuit while turning off the second gate circuit, and a second control signal turning off the first gate circuit while turning on the second gate circuit.

The first gate circuit converts an outputted voltage from the power chip to a first preset voltage according to the first control signal.

The second gate circuit converts the outputted voltage from the power chip to a second preset voltage according to the second control signal.

The controlling chip is further configured to convert the first preset voltage to a first reference voltage, and convert the second preset voltage to a second reference voltage.

A display device includes a source chip-on-film and an aforementioned voltage regulator circuit. The voltage regulator circuit is configured to input a reference voltage to the source chip-on-film.

The details of one or more embodiments of present disclosure are set forth in the accompanying drawings and the description below. Other features, objects, and advantages of present disclosure will be apparent from the description and drawings, and from the claims.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

It will be understood that when an element is referred to as being "connected" or "coupled" to another element, it can be directly connected or coupled to the other element or intervening elements may be present. Unless otherwise defined, all terms (including technical and scientific terms) used herein have the same meaning as commonly understood by one of ordinary skill in the art to which this invention belongs. The terms used herein is for the purpose of describing particular embodiments only and is not intended to limit the present disclosure.

Figure 1:
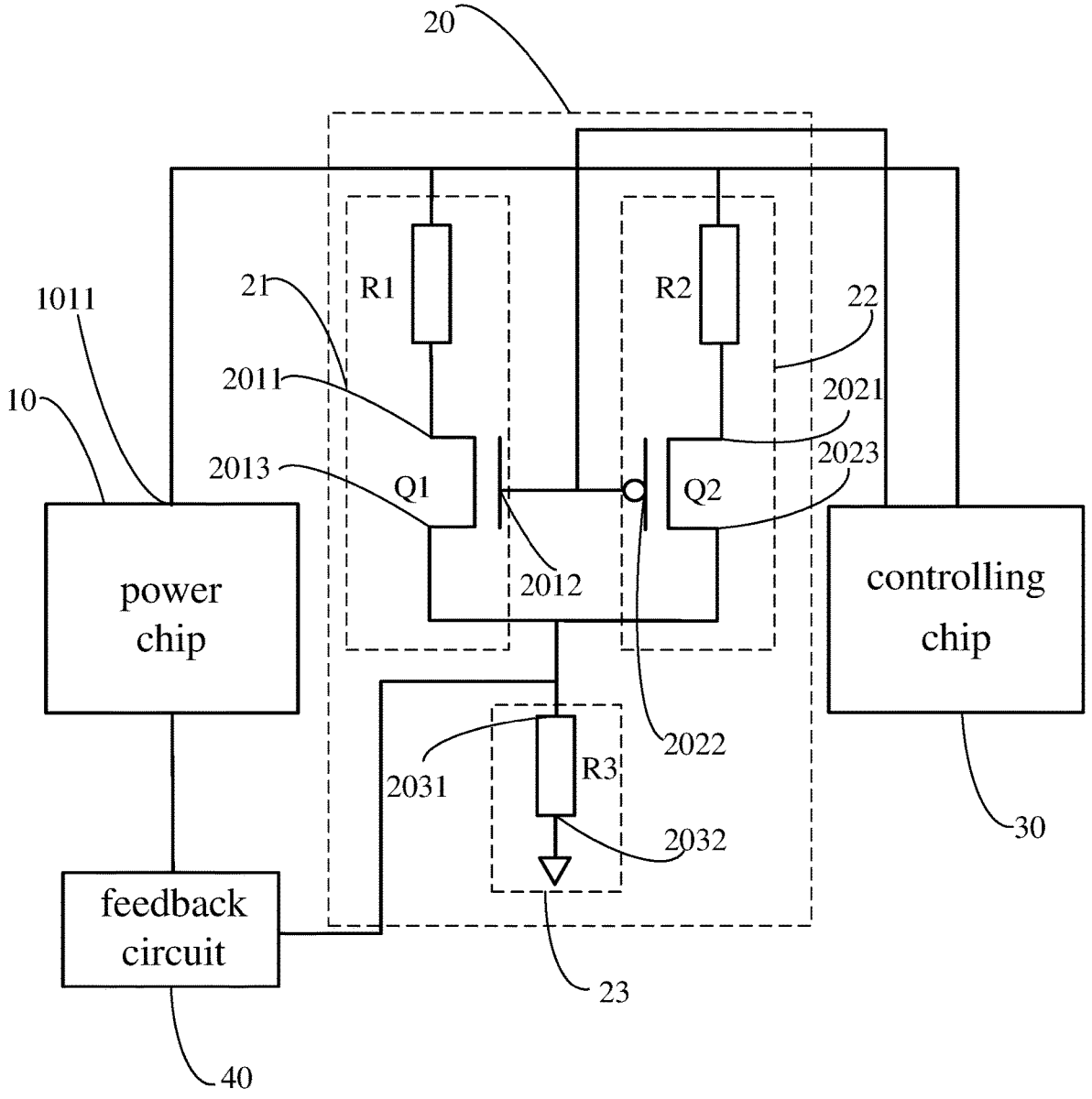
FIG. 1 is a circuit diagram of a voltage regulator circuit according to an embodiment.

Referring to FIG. 1, a voltage regulator circuit includes a power chip 10, a regulating chip 20, and a controlling chip 30. The regulating chip 20 connected to the power chip 10 and the controlling chip 30. The controlling chip 30 is configured to transmit a control signal to the regulating chip 20. The regulating chip 20 is configured to regulate an outputted voltage from the power chip 10 to a preset voltage according to the control signal, and transmit the preset voltage to the controlling chip 30. The controlling chip 30 is further configured to convert the preset voltage to a reference voltage. The controlling chip 30 is also configured to input the reference voltage to the S-COF, and the reference voltage is used as a reference value of an outputted voltage from the S-COF.

In one of the embodiments, the power chip 10 is a DC to DC power management chip. The controlling chip 30 is a microcontroller unit (MCU).

The regulating chip 20 includes a first gate circuit 21, a second gate circuit 22, and a bias circuit 23. The first gate circuit 21 is connected in parallel with the second gate circuit 22 and the connected first gate circuit 21 and second gate circuit 22 are in series with the bias circuit 23. The first gate circuit 21, second gate circuit 22, and the bias circuit 23 are located between a voltage output terminal of the power chip 10 and ground. The first gate circuit 21 and the second gate circuit 22 are both connected to the controlling chip 30, so as to receive the controlling signal.

The control signal comprises: a first control signal that turning on the first gate circuit 21 while turning off the second gate circuit 22, and a second control signal turning off the first gate circuit 21 while turning on the second gate circuit 22.

The preset voltage includes a first preset voltage and a second preset voltage.

When the controlling chip 30 transmits the first controlling signal to the first gate circuit 21 and the second gate circuit 22, the first gate circuit 21 is turned on, the outputted voltage from the power chip 10 is regulated to the first preset voltage and is transmitted to the controlling chip 30. When the controlling chip 30 transmits the second control signal to the first gate circuit 21 and the second gate circuit 21, the second gate circuit 21 is tuned on, the outputted voltage from the power chip 10 is regulated to the second preset voltage and is transmitted to the controlling chip 30.

In one of the embodiments, the first control signal is at a high level, and the second control signal is at a low level.

The voltage regulator circuit further includes a feedback circuit 40, the feedback circuit 40 is connected to the bias circuit 23 and the power circuit 10, respectively. The feedback circuit 40 is configured to detect a bias voltage of the bias circuit 23 and feedback the detected bias voltage to the power chip 10. When the bias voltage is equal to a preset bias voltage, the outputted voltage from the power chip 10 remains constant. When the bias voltage is less than the preset bias voltage, the outputted voltage is increased. When the bias voltage is greater than the preset bias voltage, the outputted voltage is reduced. The power chip 10 determines the change of the outputted voltage through the bias voltage fed back by the feedback circuit 40, and regulates the magnitude of the outputted voltage according to the change of the outputted voltage, such that the outputted voltage remains constant. In one of the embodiment, the preset bias voltage is 1.5V.

The first gate circuit 21 includes a first resistor R1 and a first electronic switch Q1. A first terminal 2011 of the first electronic switch Q1 is connected to the voltage output terminal 1011 of the power chip 10 via the first resistor R1, a second terminal 2012 of the first electronic switch Q1 is connected to the controlling chip 30, and a third terminal 2013 of the first electronic switch Q1 is connected to the bias circuit 23.

In the illustrated embodiment, the first electronic switch Q1 is a NMOS transistor or a NPN transistor, the first terminal 2011, the second terminal 2012 and the third terminal 2013 of the first electronic switch Q1 correspond to a drain, a gate, and a source of the NMOS transistor, or a collector, a base, and a emitter of the NPN transistor, respectively. In other embodiments, the first electronic switch Q1 can be any other switch with similar functions.

The second gate circuit 22 includes a second resistor R2 and a second electronic switch Q2. A first terminal 2021 of the second electronic switch Q2 is connected to the voltage output terminal 1011 of the power chip 10 via the second resistor R2, a second terminal 2022 of the second electronic switch Q2 is connected to the controlling chip 30, and a third terminal 2023 of the second electronic switch Q2 is connected to the bias circuit 23.

In the illustrated embodiment, the second electronic switch Q2 is a PMOS transistor or a PNP transistor, the first terminal 2021, the second terminal 2022 and the third terminal 2023 of the second electronic switch Q2 correspond to a drain, a gate, and a source of the PMOS transistor, or a collector, a base, and a emitter of the PNP transistor, respectively. In other embodiments, the second electronic switch Q2 can be any other switch with similar functions.

The bias circuit 23 includes a third resistor R3, a first terminal 2031 of the third resistor R3 is connected to the third terminal 2013 of the first electronic switch Q1, the third terminal 2023 of the second electronic switch Q2, and the feedback circuit 40, respectively, and a second terminal 2032 of the third resistor R3 is grounded.

The operation of the voltage regulator circuit will be described below.

The reference voltage includes a first reference voltage converted from the first preset voltage via the controlling chip 30, and a second reference voltage converted from the second preset voltage via the controlling chip 30. When the reference voltage that the S-COF needs to input is the first reference voltage, the controlling chip 30 transmits the first control signal to the second terminal of the first electronic switch Q1 and the second terminal of the second electronic switch Q2, the first electronic switch Q1 is turned on, that is, the first gate circuit 21 is turned on, the second electronic switch Q2 is turned off, that is, the second gate circuit 22 is turned off, sum of the first resistor R1 and the third resistor R3 is transmitted by the first gate circuit 21 to the control chip 30 as a first preset voltage, then the controlling chip 30 converts the first preset voltage to the first reference voltage. When the reference voltage that the S-COF needs to input is the second reference voltage, the controlling chip 30 transmits the second control signal to the second terminal of the first electronic switch Q1 and the second terminal of the second electronic switch Q2, the first electronic switch Q1 is turned off, that is, the first gate circuit 21 is turned off, the second electronic switch Q2 is turned on, that is, the second gate circuit 22 is turned on, sum of the second resistor R2 and the third resistor R3 is transmitted by the second gate circuit 22 to the control chip 30 as a second preset voltage, then the controlling chip 30 converts the first preset voltage to the second reference voltage. The first reference voltage is less than the first preset voltage, and the second reference voltage is less than the second preset voltage.

In one of the embodiments, the first preset voltage is 15V, and the second preset voltage is 18V.

Figure 2:
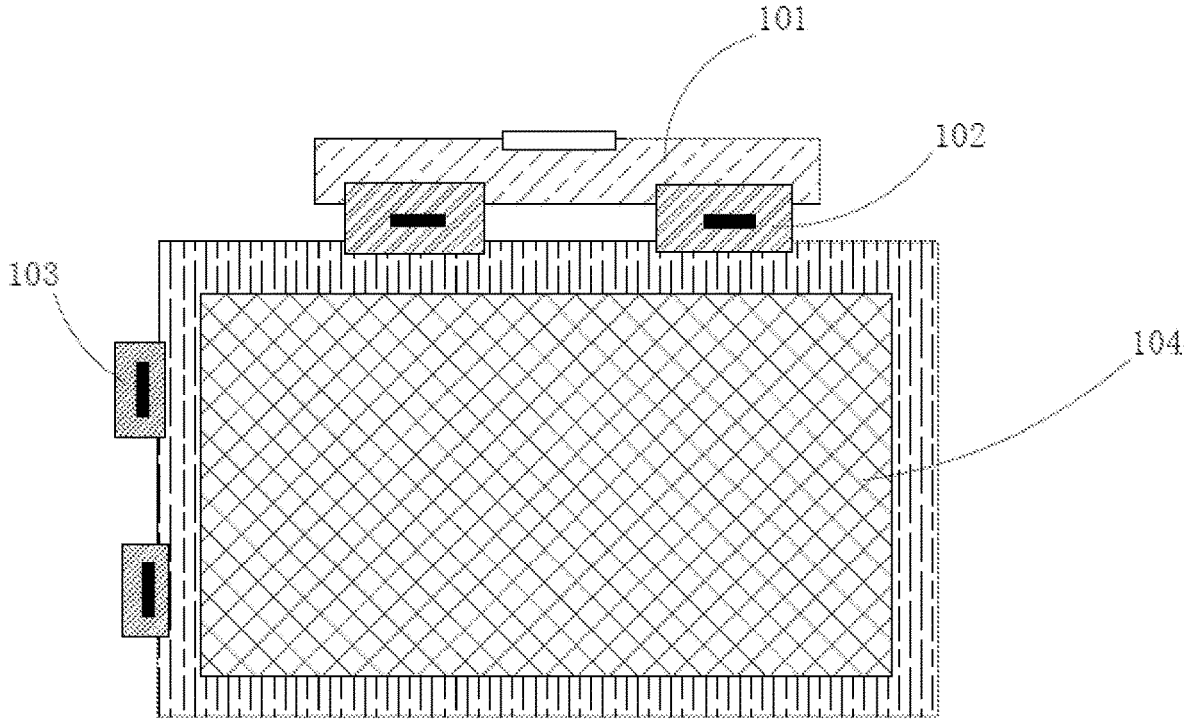
FIG. 2 is a schematic diagram of a display device according to an embodiment.

Referring to the FIG. 2, the present disclosure also provides a display device. The display device includes a printed circuit board (PCB) 101, an S-COF 102, a G-COF 103, a display panel 104, and an aforementioned voltage regulator circuit. The voltage regulator circuit is configured to input a reference voltage to the S-COF 102. The PCB 101 is connected to the display panel 104 through the S-COF 102 and the G-COF 103. A signal from a system board is transmitted to the PCB 101, and is processed by a timing controller on the PCB 101, then is transmitted to the display panel 104 through the S-COF 102 and the G-COF 103.

For example, the display panel 104 can to a liquid crystal display panel, but is not limited thereto. The display panel 104 can also be an OLED display panel, a W-OLED display panel, a QLED display panel, a plasma display panel, a curved surface display panel, or other type of display panel.

The voltage regulator circuit according to the present disclosure can provide a determined supply voltage to the controlling chip 30 according to the actual reference voltage requirements of the S-COF. Additionally, when the supply voltage to the controlling chip 30 is required to be changed, the hardware circuit is not required to be changed, such that the cost is lower and the efficiency of voltage changing is improved.

As used herein, the terms "unit", "module" and "system" and the like are intended to mean a computer-related entity, which may be hardware, a combination of hardware and software, software, or software in execution. For example, a unit may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers.

The technical features of the embodiments described above can be arbitrarily combined. In order to make the description succinct, there is no describing of all possible combinations of the various technical features in the foregoing embodiments. It should be noted that there is no contradiction in the combination of these technical features which should be considered as the scope of the description.

Although the present disclosure is illustrated and described herein with reference to specific embodiments, the present disclosure is not intended to be limited to the details shown. It is to be noted that, various modifications may be made in the details within the scope and range of equivalents of the claims and without departing from the present disclosure. Therefore, the protection scope of the present disclosure shall be subject to the protection scope of the claims.

What is claimed is:

1. A voltage regulator circuit, comprising:

a power chip;

a controlling chip, configured to transmit a control signal; and a regulating chip, connected to the power chip and the controlling chip, and configured to regulate an outputted voltage from the power chip to a preset voltage according to the control signal, and transmit the preset voltage to the controlling chip;

wherein the controlling chip is further configured to convert the preset voltage to a reference voltage, wherein the regulating chip comprises:

a first gate circuit connected to the controlling chip, and configured to receive the controlling signal;

a second gate circuit connected to the controlling chip, and configured to receive the controlling signal; and a bias circuit, wherein the first gate circuit is connected in parallel with the second gate circuit and the connected first gate circuit and second gate circuit are in series with the bias circuit, and the first gate circuit, second gate circuit, and the bias circuit is located between a voltage output terminal of the power chip and ground;

wherein the control signal comprises: a first control signal turning on the first gate circuit while turning off the second gate circuit, and a second control signal turning off the first gate circuit while turning on the second gate circuit.

2. The voltage regulator circuit according to claim 1, wherein the first control signal is at a high level, and the second control signal is at a low level.

3. The voltage regulator circuit according to claim 1, wherein the preset voltage comprises a first preset voltage and a second preset voltage;

in response to detecting that the controlling chip transmits the first control signal to the first gate circuit and the second gate circuit, the first gate circuit is tuned on, the outputted voltage from the power chip is regulated to the first preset voltage and is transmitted to the controlling chip;

in response to detecting that the controlling chip transmits the second control signal to the first gate circuit and the second gate circuit, the second gate circuit is tuned on, the outputted voltage from the power chip is regulated to the second preset voltage and is transmitted to the controlling chip.

4. The voltage regulator circuit according to claim 3, wherein the first preset voltage is 15V, and the second preset voltage is 18V.

5. The voltage regulator circuit according to claim 3, wherein the reference voltage comprises a first reference voltage converted from the first preset voltage via the controlling chip, and a second reference voltage converted from the second preset voltage via the controlling chip.

6. The voltage regulator circuit according to claim 5, wherein the first reference voltage is less than the first preset voltage, and the second reference voltage is less than the second preset voltage.

7. The voltage regulator circuit according to claim 1, further comprising a feedback circuit, wherein the feedback circuit is connected to the bias circuit and the power circuit, respectively, and the feedback circuit is configured to detect a bias voltage of the bias circuit and feedback the detected bias voltage to the power chip;

in response to detecting that the bias voltage is equal to a preset bias voltage, the outputted voltage from the power chip remains constant, in response to detecting that the bias voltage is less than the preset bias voltage, the outputted voltage is increased, and in response to detecting that the bias voltage is greater than the preset bias voltage, the outputted voltage is reduced.

8. The voltage regulator circuit according to claim 7, wherein the preset bias voltage is 1.5V.

9. The voltage regulator circuit according to claim 1, wherein the first gate circuit comprises:

a first resistor, and a first electronic switch, wherein a first terminal of the first electronic switch is connected to the voltage output terminal of the power chip via the first resistor, a second terminal of the first electronic switch is connected to the controlling chip, and a third terminal of the first electronic switch is connected to the bias circuit.

10. The voltage regulator circuit according to claim 9, wherein the first electronic switch is a NMOS transistor, the first terminal, the second terminal and the third terminal of the first electronic switch correspond to a drain, a gate, and a source of the NMOS transistor, respectively.

11. The voltage regulator circuit according to claim 9, wherein the first electronic switch is a NPN transistor, the first terminal, the second terminal and the third terminal of the first electronic switch correspond to a collector, a base, and a emitter of the NPN transistor, respectively.

12. The voltage regulator circuit according to claim 9, wherein the second gate circuit comprises:

a second resistor, and a second electronic switch, wherein a first terminal of the second electronic switch is connected to the voltage output terminal of the power chip via the second resistor, a second terminal of the second electronic switch is connected to the controlling chip, and a third terminal of the second electronic switch is connected to the bias circuit.

13. The voltage regulator circuit according to claim 12, wherein the second electronic switch is a PMOS transistor, the first terminal, the second terminal and the third terminal of the second electronic switch correspond to a drain, a gate, and a source of the PMOS transistor, respectively.

14. The voltage regulator circuit according to claim 12, wherein the second electronic switch is a PNP transistor, the first terminal, the second terminal and the third terminal of the second electronic switch correspond to a collector, a base, and a emitter of the PNP transistor, respectively.

15. The voltage regulator circuit according to claim 12, wherein the bias circuit comprises a third resistor, a first terminal of the third resistor is connected to the third terminal of the first electronic switch, the third terminal of the second electronic switch, and the feedback circuit, respectively, and a second terminal of the third resistor is grounded.

16. A display device, comprising a source chip-on-film, and the voltage regulator circuit according to claim 1, wherein the voltage regulator circuit is configured to input a reference voltage to the source chip-on-film.

17. A voltage regulator circuit, comprising:

a power chip;

a controlling chip, configured to transmit a control signal; and a regulating chip, comprising:

a first gate circuit connected to the controlling chip, and configured to receive the controlling signal;

a second gate circuit connected to the controlling chip, and configured to receive the controlling signal; and a bias circuit, wherein the first gate circuit is connected in parallel with the second gate circuit and the connected first gate circuit and second gate circuit are in series with the bias circuit, and the first gate circuit, second gate circuit, and the bias circuit are located between a voltage output terminal of the power chip and ground;

wherein the control signal comprises: a first control signal turning on the first gate circuit while turning off the second gate circuit, and a second control signal turning off the first gate circuit while turning on the second gate circuit;

the first gate circuit converts an outputted voltage from the power chip to a first preset voltage according to the first control signal;

the second gate circuit converts the outputted voltage from the power chip to a second preset voltage according to the second control signal; and the controlling chip is further configured to convert the first preset voltage to a first reference voltage, and convert the second preset voltage to a second reference voltage.

* * * * *